United States Patent [19]

Eves

[11] Patent Number: 4,712,258

[45] Date of Patent: Dec. 15, 1987

[54] BABY CHANGING MAT

[76] Inventor: Harold J. Eves, 78 Fort Picklecombe, Maker, Near Torpoint, Cornwall, United Kingdom

[21] Appl. No.: 942,956

[22] PCT Filed: Aug. 16, 1984

[86] PCT No.: PCT/GB84/00283

§ 371 Date: May 15, 1985

§ 102(e) Date: May 15, 1985

[87] PCT Pub. No.: WO85/01197

PCT Pub. Date: Mar. 28, 1985

Related U.S. Application Data

[63] Continuation of Ser. No. 740,042, May 15, 1985, abandoned.

[30] Foreign Application Priority Data

Sep. 17, 1983 [GB] United Kingdom ..... 832490

[51] Int. Cl.[4] ..... A47C 27/08

[52] U.S. Cl. ..... 5/424; 5/420; 5/431; 5/99 R

[58] Field of Search ..... 5/99 R, 417, 419, 420, 5/424, 431, 437, 440, 446, 447; 128/133, 328

[56] References Cited

U.S. PATENT DOCUMENTS

| | | | |
|---|---|---|---|
| 2,846,700 | 8/1958 | De Puy . | |
| 3,269,621 | 8/1966 | Dishart . | |
| 3,423,127 | 1/1969 | Shankman | 5/420 |
| 3,556,092 | 1/1971 | Eisenberg | 128/133 |
| 3,636,577 | 1/1972 | Nissen | 5/420 |
| 3,659,297 | 5/1972 | Schutz . | |
| 3,721,434 | 3/1973 | Spies | 5/424 |
| 3,879,775 | 4/1975 | Iwata | 5/420 |
| 3,889,668 | 6/1975 | Ochs et al. | 5/82 |
| 3,968,911 | 7/1976 | Haas | 5/424 |
| 3,976,113 | 8/1976 | Kim | 5/417 |
| 3,999,490 | 12/1976 | Rocker et al. . | |
| 4,123,809 | 11/1978 | Pugh | 5/420 |
| 4,142,522 | 3/1979 | Hill | 128/133 |
| 4,216,951 | 8/1980 | Griffin . | |

FOREIGN PATENT DOCUMENTS

| | | | |
|---|---|---|---|
| 506137 | 10/1951 | Belgium . | |
| 2227542 | 6/1972 | Fed. Rep. of Germany . | |
| 1502033 | 11/1967 | France . | |
| 943965 | 12/1963 | United Kingdom | 5/420 |
| 1264919 | 2/1979 | United Kingdom | 5/417 |

*Primary Examiner*—Gary L. Smith
*Assistant Examiner*—Michael F. Trettel
*Attorney, Agent, or Firm*—Thomas J. Greer, Jr.

[57] ABSTRACT

A baby changing mat comprising a central padded body with a raised sill extending about a majority of the edge of the body and a pair of straps for holding a baby to the mat. The mat is formed from a flexible material and has at least one centrally located transverse stabilizing member to which the straps may be anchored. Extra padding may be provided for the baby's head.

14 Claims, 9 Drawing Figures

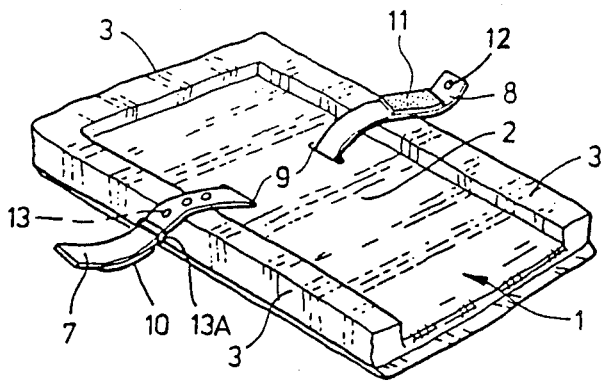
FIG 1
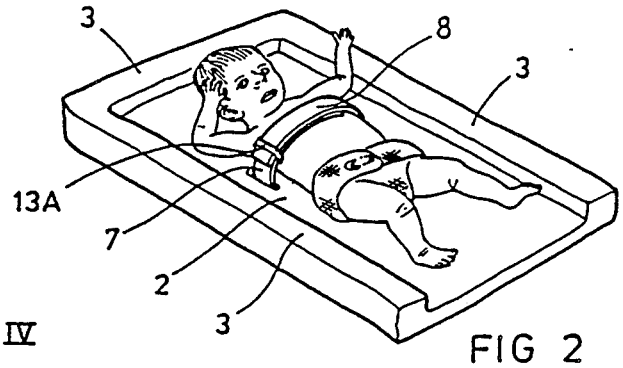
FIG 2
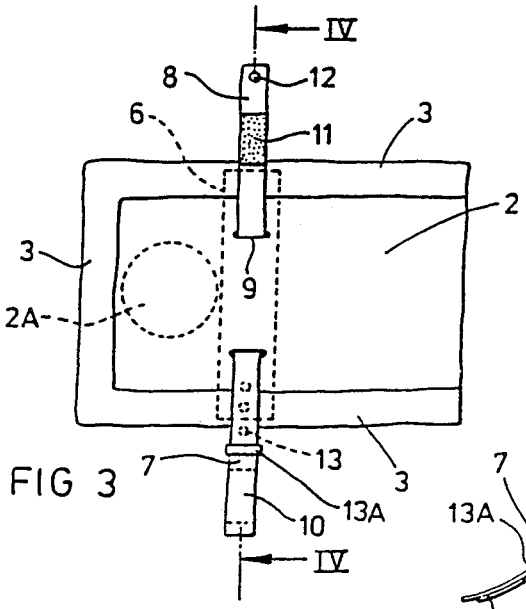
FIG 3
FIG 4
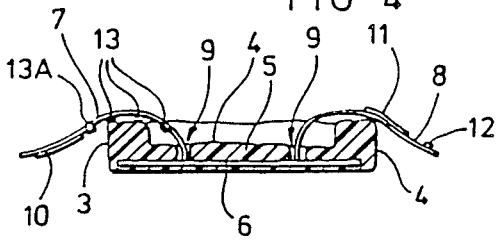

BABY CHANGING MAT

This application is a continuation of Ser. No. 740,042, filed May 15, 1985, now abandoned.

The present invention relates to a baby changing mat upon which a baby can be placed when being changed.

Known baby changing mats typically comprise a rectangular padded mat providing a central working area which is surrounded on three sides by a padded sill. The mat is generally formed by a flexible plastics material casing filled with a flexible foamed plastics material acting as padding. Due to this construction, the mat has little rigidity but provides a comfortable, easily cleaned, working surface upon which a baby can be laid while being changed.

Of course, a lively baby will not lie meekly on the mat while being changed but will wriggle and twist about. As a result, the person changing the baby generally has to use one hand at least intermittently to restrain the baby. Indeed, unless continually restrained, the baby is quite likely to roll off the mat which could possibly result in injury.

It is an object of the present invention to provide a baby changing mat which overcomes the difficulties, outlined above, that are experienced with known mats.

According to one aspect of the present invention, there is provided a baby changing mat having releasable restraining means which in use of the mat serve to hold the upper part of a baby down upon the mat, and transverse stabilising means substantially preventing a baby held by said restraining means from rolling the mat or itself over sideways. The restraining means also helps to prevent the baby sitting up while it is being changed.

A mat of this form enables a baby to be firmly and safely kept in position while being changed, there being substantially no risk of the baby wriggling or rolling off the mat or tipping the mat over sideways; in addition, the person changing the baby can freely use both hands.

In one embodiment, the restraining means are constituted by two straps arranged to pass up around the chest of the baby and to be fastened together by releasable fastening means, for example, constituted by a press stud or studs or cooperating parts of a touch and close fastener. A suitable form of touch and close fastener is one formed by cooperating "Velcro" (Registered Trade Mark) strips. A buckle may alternatively be used.

In another embodiment the restraining means is constituted by a harness releasably coupled to the mat. With this arrangement the harness can be placed on a baby prior to laying the latter on the mat. Preferably, the harness is releasably coupled to the mat by means of clips arranged to cooperate with anchorages attached to the mat.

The transverse stabilising means will generally be constituted by means serving to render the mat substantially rigid transversely, at least over part of its longitudinal extent; the transverse stabilising means are thus typically constituted by a substantially rigid transverse member which extends over substantially the whole width of the mat and over part or all of the length of the mat, the baby being protected from the said member by padding. Advantageously, where the restraining means are constituted by straps, the latter are directly or indirectly secured to the said transverse member.

The restraining means and stabilising means can be provided as an integral part of the mat structure or else as separate items which can be bought as accessories to a basic mat. Thus where the restraining and stabilising means are jointly constituted by a substantially rigid member carrying a pair of straps, then either the said member can be incorporated within the mat with the straps extending up through the mat working surface, or both the rigid member and the straps can be provided as an accessory with the said member, in use, being placed beneath the mat and the straps threaded through preformed apertures in the mat to extend out of the mat's working surface.

Advantageously, the undersurface of the mat is provided with non-slip means (such as, for example strips of rubber) to prevent the mat from moving across the surface upon which it rests as a baby twists and wriggles on the mat.

Mats embodying the invention may be incorporated in other pieces of equipment such as a baby dresser/-changing table unit or a portable changing mat/bag. In the former case, the mat is generally provided on the rigid top of the dresser unit, this top surface serving as the said transverse stabilising means for the mat.

The head of a baby, which is particularly vulnerable, may be supported and protected by the provision in the padded central working area of the mat of a region of increased thickness, for example, in the form of extra padding, in the part of the mat on which the baby's head rests in use of the mat. The mat may be provided with pockets for receiving spare baby clothes or nappies; such spare clothes may themselves act as additional padding.

The mat according to the invention may be designed to be folded upwardly along fold lines on both sides of the transverse stabilising member to form the side walls of a carrier bag when the mat is not in use, releasable fastener means being provided for interconnecting the longitudinal side edges of the mat when the latter is so folded, the transverse stabilising member then serving as a base for the bag. The bag thus formed may be used for carrying baby feeding bottles, talcum powder, nappies and clothes. In a preferred embodiment of the invention the two restraining straps are each anchored to the substantially rigid transverse member by two press studs or rivets which can act as or secure feet on which the mat may rest when it is folded to form a carrier bag.

According to another aspect of the invention there is provided a baby changing mat having releasable restraining means which in use of the mat serve to hold the upper part of a baby down upon the mat.

The invention will now be more particularly described, by way of example, with reference to the accompanying diagrammatic drawings in which:

FIG. 1 is a perspective view of a first form of baby changing mat embodying the invention;

FIG. 2 is a view similar to FIG. 1 but showing the first form of mat in use with a baby held firmly on the mat by restraining straps with which the mat is provided;

FIG. 3 is a plan view of the FIG. 1 mat;

FIG. 4 is a cross-section taken on line IV—IV in FIG. 1;

The same reference numerals are used throughout the drawings to designate the same or corresponding component parts of the baby changing mats.

Figure 5:
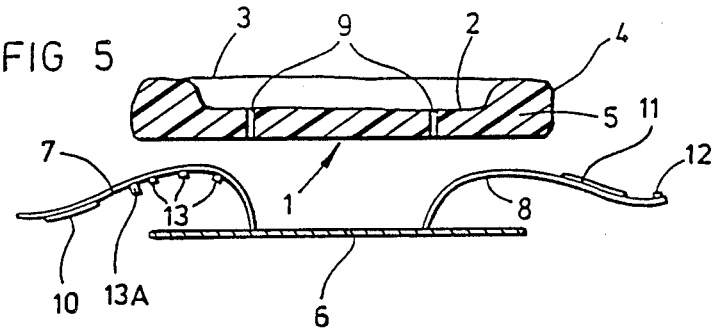
FIG. 5 is a cross sectional view similar to FIG. 4 but showing two separate components of a second form of baby changing mat embodying the invention.

The form of baby changing mat shown in FIGS. 1 to 4 comprises a rectangular padded body generally indicated 1 which provides a central working zone 2 that is surrounded on three sides by a low sill 3. The padded body 1 takes the form of a waterproof casing 4 of flexible plastics material filled with foam rubber or other suitable padding 5.

The padded body 1 has little inherent rigidity and can be readily deformed from its generally flat condition illustrated in FIG. 1. However in the illustrated mat, the padded body 1 is given transverse rigidity by means of a rigid transverse member 6 that extends substantially the whole way across the body 1. The transverse member 6 is interposed between the bottom of the padding 5 and the casing 4 in a longitudinally central region of the mat.

Typical dimensions for the rigid transverse member 6 are as follows:

Length—400 mm
Width—50–150 mm
Thickness—3–5 mm

The thickness will, of course, depend on the stiffness of the material used for the member 6, suitable materials being metal, wood and plastics.

Attached to the member 6 are two strong but soft restraining straps 7, 8 made of cloth (for example, towelling), plastics (for example, polypropylene or nylon) or other suitable material. Each strap 7, 8 is approximately 400 mm long and 40–50 mm wide. The straps 7 and 8 extend up through the padding 5 to emerge through apertures 9 in the upper surface of the casing 4.

The position of the member 6 and of the apertures 9 is such that the straps 7 and 8 pass through the casing 4 at locations which would normally be just below the armpits of a baby laid on the mat in the orientation illustrated in FIG. 2. These locations are also such that the straps 7 and 8 will pass up beside a baby laid centrally on the mat either inwardly inclined or slightly outwardly inclined, according to the size of the baby.

The straps 7 and 8 are provided with respective cooperating parts 10 and 11 of a touch and close fastener, these parts 10 and 11 being, for example, constituted by 150 mm lengths of hook and loop VELCRO (Registered Trade Mark) material. A fastener of this form permits the straps 7 and 8 to be releasably fastened together over a range of different positions. Press studs or other suitable fastenings may be used in place of the touch and close fasteners.

In addition to the touch and close fastener part 11, the strap 8 is also provided, at its free end, with one part 12 of a press stud fastener. This part 12 is arranged to engage in any one of three complementary press-stud parts 13 provided on the strap 7 in positions respectively nearer the root of this strap. Alternatively a retaining loop 13A may be provided on the lower strap 7 to hold the end of the upper strap 8.

In use of the baby changing mat of FIGS. 1 to 4, a baby to be changed is laid on the central working area 2 of the mat and the straps 7 and 8 are pulled gently over the baby's chest and fastened together by means of the touch and close fastener constituted by the cooperating parts 10 and 11. The free end of the uppermost strap 8 is also fastened down by engagement of the press-stud part 12 in the appropriate one of the complementary press-stud parts 13 provided on the strap 7, or by passing this free end through the retaining loop.

The upper part of the baby's body is thus held firmly but gently down against the mat by the straps 7 and 8, which resist any attempt by the baby to sit up while it is being changed.

Furthermore, any attempt of the baby to roll sideways will be thwarted by the stabilising effect of the rigid transverse member 6. The baby is thus firmly and safely held by the mat so that the person changing the baby is free to use both hands.

A zone 2A of double thickness padding is preferably provided in the region of the baby's head (that is, the top third of the mat) to ensure that the baby cannot harm itself by its efforts to release itself from the straps, or when the baby is lowering its head onto the mat. Furthermore, as an added stabilising feature, the undersurface of the mat can be provided with non-slip means to prevent it from moving across the surface upon which it rests as the baby moves. Such non-slip means may comprise, for example, a coating of non-slip material, or suction cups affixed to the underside of the mat.

The form of baby changing mat shown in FIG. 5 is very similar to that of FIGS. 1 to 4 except that the transverse member 6 and the straps 7 and 8 are made separate from the padded body 1. To this end, the apertures 9 are extended to open out into the bottom surface of the casing 4 as well as the upper surface of the latter. Furthermore, the rigid member 6 is not enclosed within the casing 4.

In use of the form of mat shown in FIG. 5, the straps 7 and 8 are threaded through the apertures 9 from below until the padded body 1 is seated on the rigid transverse member 6.

Thereafter, the mat is used in exactly the same manner as the mat shown in FIGS. 1 to 4.

One reason for providing the member 6 and straps 7 and 8 in the form of a separate entity to the padded body 1 is that it would enable a basic mat of the FIG. 5 form to be purchased and later improved by the addition of the member 6 and straps 7.

Various modifications to the described forms of baby changing mat are, of course, possible. Thus, in addition to the transverse rigid member 6, a longitudinal rigid member could also be provided to prevent the baby sitting up. Alternatively, the member 6 could be arranged to extend not only over the whole width of the mat but also over substantially its full length. Furthermore, the member 6 need not be of sheet form but could be of a frame construction.

The straps 7 and 8 may simply be constituted by opposite ends of a single strap passed through both apertures 9.

Figure 6:
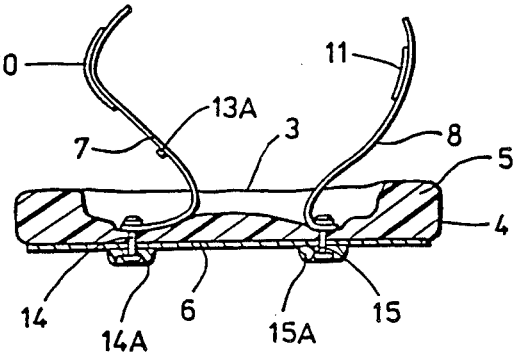
FIGS. 6 and 7 are respective cross sectional views showing two further variants of the baby changing mat shown in FIG. 4.

It is not essential that the straps 7 and 8 be directly attached to the rigid transverse member 6; thus the straps could be attached to the upper surface of the casing 4 and in this case this upper surface is preferably directly attached to the member 6. One such version of a baby changing mat is shown in FIG. 6, in which the two straps 7 and 8 are anchored to the upper surface of the casing 4 by respective rivets or other fastenings 14, 15 which pass through the padded body 1 and are anchored to the transverse stabilising member 6, which may be beneath the mat, as shown, or within the padding 5.

Figure 7:
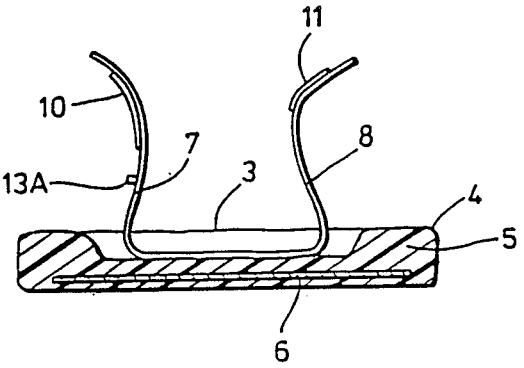

The fastenings 14, 15 may to advantage incorporate releasable press-stud fasteners at the upper surface of the casing 4 by means of which the straps 7, 8 can be releasably attached to the mat. The straps 7, 8 may then be made of soft washable material such as towelling and may easily be detached from the mat for periodic washing.

Where the straps 7 and 8 are not directly attached to the substantially rigid stabilising member 6, the latter need not lie directly beneath the straps 7 and 8. For example, a stabilising member or members could be provided at one or both ends of the mat. In one practical form of such a mat, illustrated in FIG. 7, the two straps 7, 8 comprise the opposite ends of a single strip of plastics material welded, stitched or otherwise attached to the upper surface of the casing 4. The two straps 7, 8 could, of course, be attached separately to the upper surface of the casing.

In theory at least, transverse stabilising means other than a rigid transverse member could be provided such as, for example, very heavy weights contained in the longitudinally running sills 3. These weights would serve to hold the edges of the mat down thereby preventing the baby turning the mat over sideways. This latter form of transverse stabilising means is not, of course, very practical and the use of a rigid transverse member is preferred. The transverse stabilising means could alternatively take the form of suitably placed suction cups on the underside of the mat.

The restraining means, instead of comprising straps 7 and 8, may take the form of a more complicated chest and shoulder harness, but experience has shown that the simple two strap arrangement illustrated in the drawings is wholly adequate. Where a harness is employed then preferably it can be uncoupled from the mat to facilitate placing of the harness on a baby. Thus, for example, the harness may be provided with clips that are arranged to engage cooperating fixtures provided on the mat; indeed, harnesses of this type are already known for securing babies in pushchairs and highchairs.

The mat itself may be incorporated in other items of equipment such as a changing dresser/table unit or a portable changing mat/bag. In the former case, it is known to provide a padded body on the rigid top of a dresser unit; with such an arrangement, there is no need to provide a separate rigid transverse member 6 since the rigid top to the unit will itself ensure the required transverse stability. The baby changing mat may be incorporated into a baby-carrying frame, in which case the frame itself may be such as to provide adequate transverse stability during use of the mat.

Figure 8:
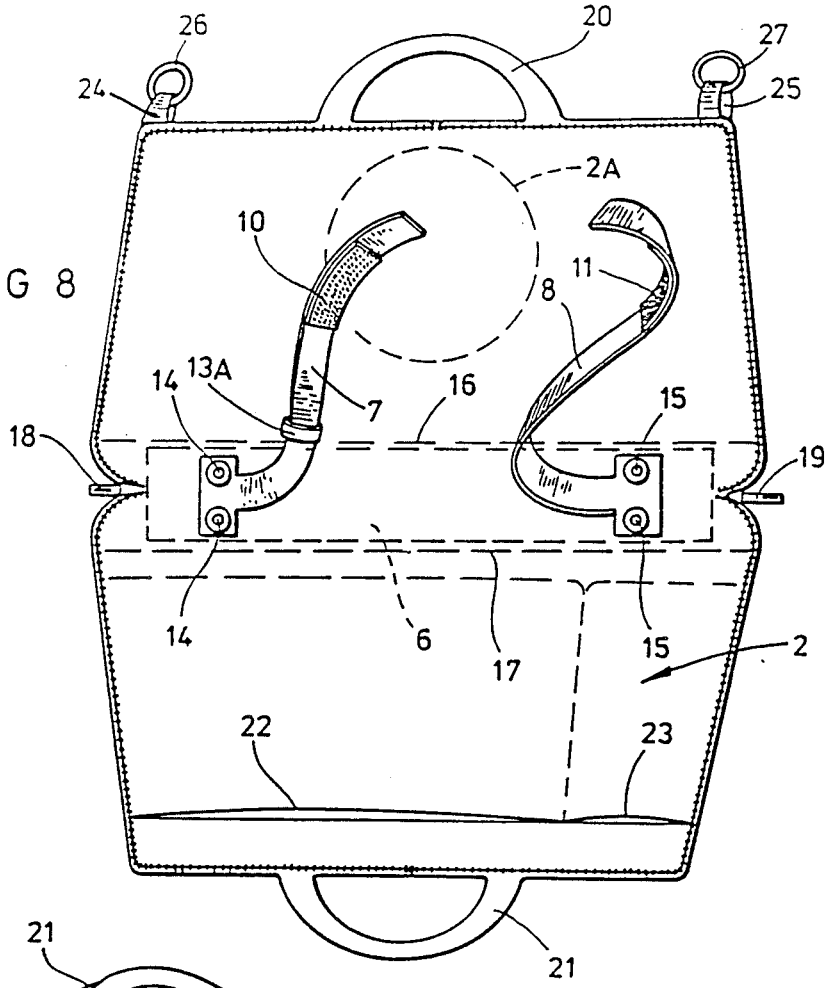
FIG. 8 is a plan view of a baby changing mat according to another embodiment of the invention.
Figure 9:
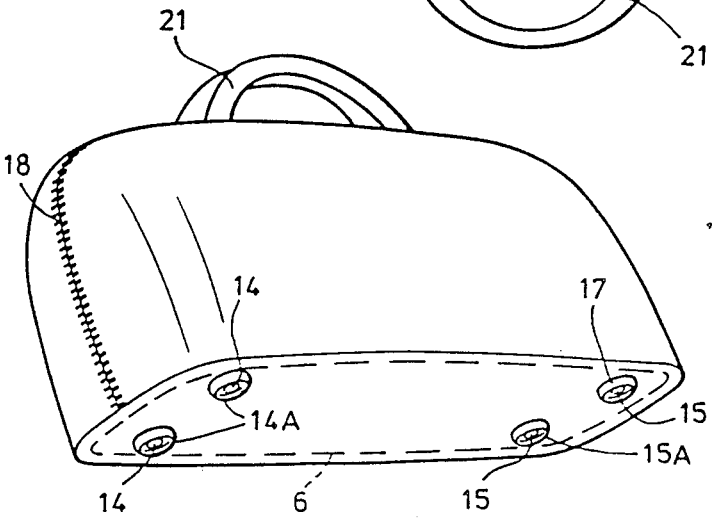
FIG. 9 is a perspective view of the mat shown in FIG. 8, folded up to form a carrier bag.

FIGS. 8 and 9 illustrate a further embodiment of the invention according to which the baby changing mat, when not in use, can be folded up to form a convenient carrier bag. The mat has a padded body 1 incorporating, in a central position, a substantially rigid transverse stabilising member 6 of sufficient width to act as a base of a bag formed by upward folding of the body on both sides of the member 6 (FIG. 9). The padded sill 3 is omitted, and the body 1 is formed with transverse fold lines or creases 16, 17 on opposite sides of the stabilising member 6.

The working upper surface of the mat, which becomes the interior surface when the mat is folded up to form a bag, is afforded by a waterproof plastics sheet material; the lower surface of the mat, which becomes the outer surface of the bag, may be of a substantial hard-wearing fashion material such as a textile or synthetic fabric.

Two restraining straps 7, 8 are attached to the upper surface of the mat, each strap 7, 8 being secured by a respective pair of rivets 14, 15 passing through the body 1 and anchored to the transverse stabilising member 6. The rivets 14, 15 also serve to attach rubber, metal or plastics feet 14A, 15A to the bottom of the mat. The two rivets of each pair 14, 15 are spaced apart in the longitudinal direction so that the feet 14A, 15A lie at the four corners of the rectangular stabilising member 6 and can support the mat stably when it is folded up to form a bag (FIG. 9). It will be appreciated that other methods of securing the straps 7, 8 to the mat or to the stabilising member 6 may be employed, as, for example, in the embodiments described previously.

Two releasable fasteners 18, 19, which are shown as sliding clasp fasteners but may be press studs, are provided for interconnecting the longitudinal side edges of the mat when the mat is folded up to form a bag. The fasteners 18, 19 also extend along the top and bottom edges of the mat for closing the bag formed by folding up the mat.

Carrying straps or handles 20, 21 are provided at the opposite ends of the padded body 1 of the mat, so that the two handles 20, 21 come together to facilitate carrying of the mat when it is folded up to form a bag. Alternatively, a single carrying handle 20 may be provided at one end of the mat.

A pocket 22 is provided in the upper surface of the casing 4, in the lower half of the mat, the pocket being open towards the bottom edge of the mat. The pocket 22, which is formed by a plastics sheet welded or stitched along three edges to the casing 4, is intended to receive clean baby clothes or nappies when the mat is folded up to form a bag, keeping them separate from soiled clothes which can be carried in the main body of the bag. A compartment 23 is formed by stitched or welded seams in the pocket 22 for the purpose of holding a baby's feeding bottle in an upright position when the mat is folded up to form a bag.

A pair of tabs 24, 25 provided with rings 26, 27 are affixed to the two corners of the mat at one end, for releasably attaching a shoulder strap (not shown) for carrying the bag or for releasably attaching the bag to the handles of a preambulator or push-chair.

Although the transverse stabilising means, in whatever form provided, are desirable for the reasons explained, they could be omitted from the previously described baby changing mats, the presence of the restraining means itself constituting a significant improvement over prior art mats.

I claim:

1. A portable baby changing mat comprising a flexible padded body intended to be used on any flat substantially rigid horizontal surface and provided with means for resisting lateral movement of a baby lying on the upper, working surface of the mat, the mat further comprising a substantially rigid transverse stabilising member located below the said working surface of the mat and extending across the full width of the mat but with a limited extent along the length of the mat and fixed relative to the mat, the mat retaining longitudinal flexibility at all portions not coextensive with said stabilising member, the means for resisting lateral movement of a baby comprising straps attached to the mat to cooperate with the said stabilising member and arranged to be secured around the chest of the baby lying on its back on the mat to hold the baby on the mat, so that the baby is prevented from rolling the mat or itself over sideways by the combined action of the transverse stabilising member and the straps.

2. A baby changing mat according to claim 1, characterized in that the straps (7,8) are releasably connected to anchorages attached to the mat.

3. A baby changing mat according to claim 2, in which the anchorages for the straps (7,8) are secured to the stabilizing member (6).

4. A baby changing mat according to claim 1, characterized in that the restraining straps (7,8) are anchored to the transverse member (6) by anchoring means passing through the mat to attach the straps to the working surface of the mat.

5. A baby changing mat according to claim 1, characterized in that the restraining straps (7,8) are formed by their ends being attached to the working surface of the mat.

6. A baby changing mat according to claim 1, characterized in that the restraining straps (7,8) are attached directly to the said transverse member (6) and pass through the working surface of the mat.

7. A baby changing mat according to claim 1, modified in that instead of straps there is provided a harness releasably connected to anchorages attached to the mat.

8. A baby changing mat according to claim 7, wherein the anchorages for the harness are attached to the stabilizing member.

9. A baby changing mat according to claim 1, in which the mat has a padded central working area (2), characterized in that the padded area (2) has a region of increased thickness in the part on which the baby's head rests in use of the mat.

10. A baby changing mat according to claim 1, characterized in that the mat is provided on its working surface with at least one pocket (22) for receiving spare baby clothes or nappies.

11. A baby changing mat according to claim 1, characterized in that the mat is designed to be folded upwardly along fold lines (16,17) on both sides of the transverse stabilizing member (6) to form the side walls of a carrier bag when the mat is not in use, releasable fastener means (18,19) being provided for interconnecting the longitudinal side edges of the mat when the latter is so folded, the transverse stabilizing member (6) then serving as a base for the bag.

12. A baby changing mat according to claim 11, characterized in that each of the restraining straps (7,8) is anchored to the substantially rigid transverse member (6) by two press studs or rivets (14) spaced apart longitudinally of the mat, the four studs or rivets serving as or attaching feet (16,17) on which the mat may rest when it is folded to form a carrier bag.

13. A baby changing mat according to claim 11, characterized in that a carrying means (20) is provided at at least one end of the mat, facilitating carrying of the latter when folded to form a bag.

14. A baby changing mat according to claim 11, including attachments (26,27) at one end of the mat for releasably attaching a carrying strap or for releasably suspending the mat when the latter is folded up to form a bag.

* * * * *